United States Patent [19]

Bencic

[11] Patent Number: 4,948,266

[45] Date of Patent: Aug. 14, 1990

[54] DISPOSABLE RECEPTACLE

[76] Inventor: David M. Bencic, 2422 Batavia-Oakfield Townline Rd., Batavia, N.Y. 14020

[21] Appl. No.: 364,147

[22] Filed: Jun. 12, 1989

[51] Int. Cl.[5] ..... B65D 33/02; B65D 33/14; B65D 33/18

[52] U.S. Cl. ..... 383/34; 220/404; 294/1.3; 383/12; 383/43

[58] Field of Search ..... 383/34, 12, 93; 55/367, 55/DIG. 2; 294/1.3; 220/404

[56] References Cited

U.S. PATENT DOCUMENTS

| | | | |
|---|---|---|---|
| 2,621,757 | 12/1952 | Anderson | 55/DIG. 2 |
| 3,176,450 | 4/1965 | Weinstein | 55/367 |
| 3,401,867 | 9/1968 | Long et al. | 55/367 |
| 3,457,706 | 7/1969 | Fesco | 55/367 |
| 3,739,418 | 6/1973 | Yonaites et al. | 383/93 |
| 3,806,984 | 4/1974 | Hilsabeck | 383/34 |
| 3,978,540 | 9/1976 | Peck | 294/1.3 |

FOREIGN PATENT DOCUMENTS

| | | | |
|---|---|---|---|
| 661077 | 6/1987 | Switzerland | 294/1.3 |

*Primary Examiner*—Stephen P. Garbe
*Attorney, Agent, or Firm*—James J. Ralabate

[57] ABSTRACT

The invention is directed to a disposable waste bag with an upper frame member and a flexible bag attached thereto. The frame member has adhesive for securing the bag closed after the bag has been filled with waste or debris. Along two parallel sides of the frame member are fold lines along which the frame member can be folded upon itself to seal the bag when full. The frame member is slightly larger than an opening of a container in which it is used.

14 Claims, 2 Drawing Sheets

Fig. 1
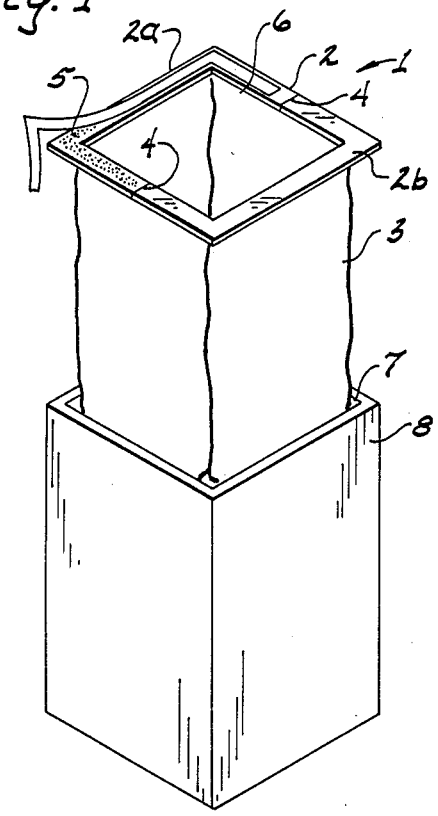
Fig. 2
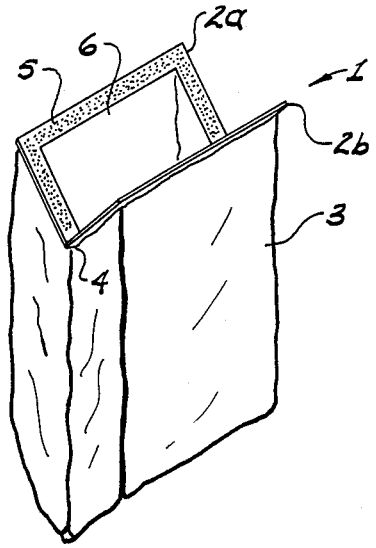
Fig. 3
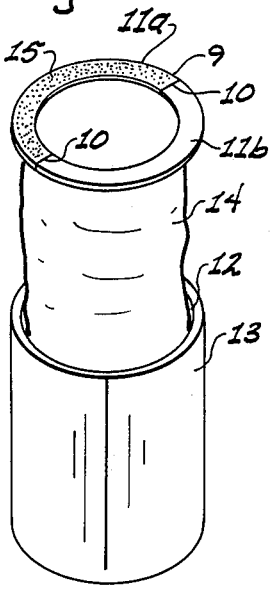
Fig. 4
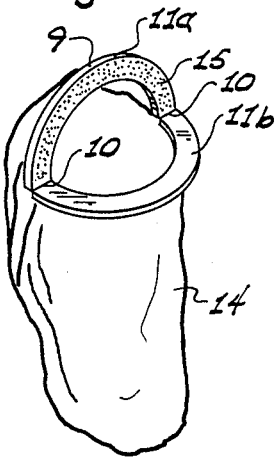
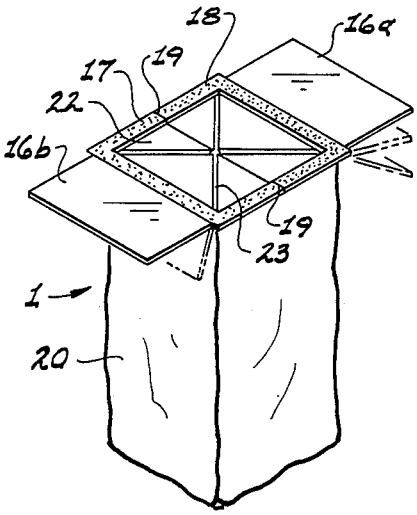
Fig. 5
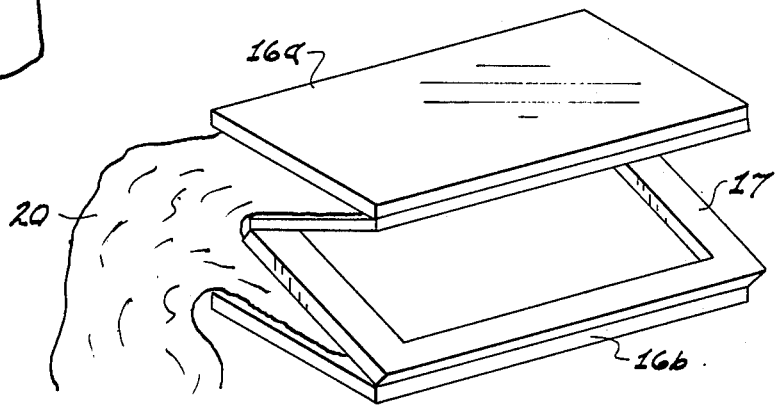
Fig. 6

DISPOSABLE RECEPTACLE

This invention relates to a disposable bag for use in various waste receptacles.

BACKGROUND OF THE INVENTION

There are several instances such as in bathrooms, hotels, medical offices, laboratories and the like where disposable waste containers are desirable. In addition, in domestic uses such as in waste baskets, trash containers, diaper pails, auto litter containers, containers for beverage bottles or cans, disposable containers are not only desirable but required.

Many known disposable containers have been proposed such as those in U.S. Pat. Nos. 2,528,332; 2,574,683; 3,176,450; 3,200,571; 3,237,846; 3,401,867 and 3,421,298. In U.S. Pat. No. 2,528,332 (Bergquist) a container is described having a self-acting closure. In Bergquist a closure for a receptacle is disclosed having a top structure comprising a two-sheet arrangement. These sheets interlock to self close after waste contents are deposited therethrough. The structure of Bergquist permits the top overlying layer to provide somewhat of a seal because of its overlying structure in relationship to the opening of the bottom layer. The two layers overlap to provide somewhat of a seal. However, the closure is not complete after the receptacle is full and ready to be discarded. A complete closing of the receptacle of Bergquist is not possible with the structure he offers. Also, there is no provision in Bergquist for supporting or holding in place his receptacle in a container or waste collector. In Anderson U.S. Pat. No. 2,574,683 a duct receptacle for a vacuum cleaner is disclosed. This receptacle has a mouth body which automatically closes when cuts or openings 35 of Anderson are closed. There is no means in Anderson for vertical support of this receptacle in a container. In Weinstein U.S. Pat. No. 3,176,450 a vacuum cleaner bag is disclosed having end sealing means in the form of ears 41 and 42 which flex back in place after being distorted by passage therethrough of debris. There is no provision in Weinstein or in U.S. Pat. Nos. 3,200,571; 3,237,846; 3,401,867 or 3,421,298 for securely closing the containers nor for supporting the receptacle or bags in a vertical position in a container.

SUMMARY OF THE INVENTION

It is therefore an object of this invention to provide a disposable receptacle or bag devoid of the above-noted disadvantages.

Another object of this invention is to provide a receptacle or disposable bag that can easily fit into waste baskets or other debris containers.

Still another object of this invention is to provide an economical disposable bag for use in homes, hotels, medical facilities and the like.

Still a further object is to provide a disposable bag that can be securely closed after use.

A still further object is to provide a disposable receptacle or bag that can be fixed in place in a waste basket or other container.

Another still further object is to provide a disposable bag or receptacle that is easily folded for storage or shipping before use.

These and other objects are accomplished according to this invention by providing a disposable waste bag comprising an upper frame member having fold indentations whereon the upper frame can be folded upon itself to securely close and seal the bag top after use. This is desirable to prevent the contents from spilling out or to confine odors from the contents such as diapers and the like. The frame member has an adhesive on its upper surface that will allow frame halves to be secured together after folding. The adhesive can be a peel-off type or any other suitable adhesive means. The frame diameter can be slightly larger than the opening of a container so that the bag will be held in place with its opening above the container opening. The frame member can be of any suitable configuration to fit the container to be used. It is preferred for best results that the frame has attached thereto flaps for holding the bag in position and also for assisting in providing a secure closure means. While one flap may be used it is preferred that at least two flaps be used for best results and support. The flaps may also be used as the outside closure when the disposable bag is folded before use. The opening of the frame is preferred to be covered by a self-closing sheet material having slits therein to provide a closure while the bag is in use. The self-closing sheet material can be a thin plastic, paper or other sheet material which is cut or made of pieces in such a manner as to allow items to be put through the frame opening and into the container. By using such a sheet closure, contents of the container would not be visible during use. Also, odors from within the container would be somewhat confined during use. Also, items could be tossed into the container without opening a lid; the opening would be self-opening and self-closing. The frame can have sides as in the structure of a box top so that the frame would fit over the peripheral portion of the container opening. When this embodiment is used, located approximately halfway down two parallel sides will be perforated tear lines where the frame can be torn and folded upon itself to be secured by the adhesive means after use. The frames and flaps of the bag of this invention can be constructed of cardboard or any other suitable material. The bag body itself can be constructed of materials like any conventional trash bag. In its basic form the invention comprises a frame or supporting member made of cardboard or sheet material with attached bag where the frame keeps the bag open for placing items in the bag through an opening in the frame. The frame also supports the bag when inserted in various containers. The frame can be square, circular, or other such shape. The top of the bag is attached to the underside of the frame, thus giving a neat appearance when viewed from the top. When the bag is full or being disposed of, the frame can be folded upon itself to seal the opening and keep the contents in the bag. Adhesive, tape, strip-off tape or other means could be provided to keep the frame folded shut. The frame and/or the opening may be rectangular, square, circular, or other suitable shape.

BRIEF DESCRIPTION OF THE DRAWING

FIG. 1 is a perspective view of the disposable bag of this invention when in a rectangular form.

FIG. 2 is a perspective view of the rectangular disposable bag of this invention when a folded form after use, prior to sealing.

FIG. 3 is a perspective view of the disposable bag of this invention when in a circular form.

FIG. 4 is a perspective view of the circular disposable bag of this invention when in a folded form after use, prior to sealing.

FIG. 5 is a perspective view of the disposable bag of this invention with two flaps and a self-closing sheet covering the frame opening.

FIG. 6 is a perspective view of the disposable bag of this invention when folded prior to opening and unfolding in preparation for use.

DETAILED DESCRIPTION OF DRAWING AND PREFERRED EMBODIMENTS

Figure 7:
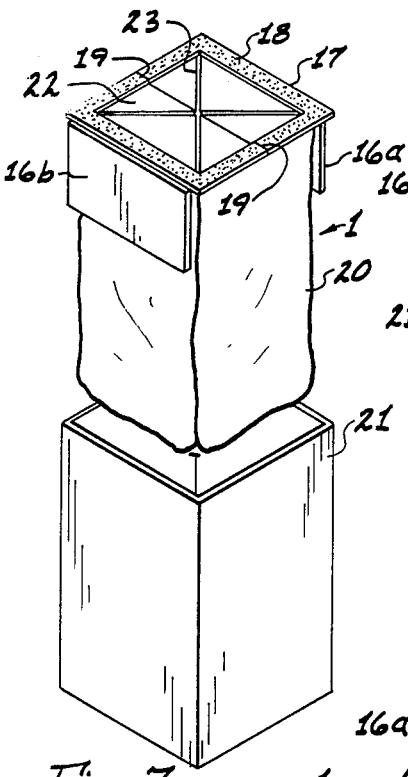
FIG. 7 is a perspective view of the disposable bag of this invention as it is about to be installed into a container.

In FIG. 1 the bag unit 1 of this invention is shown comprising an upper frame means 2 having attached to its bottom portion a flexible plastic bag 3. The frame 2 has fold indentations or lines 4 located on two parallel sides of frame 2. The term "fold" is intended to include tear lines. When the bag 3 is full or being disposed of the frame 2 can be folded upon itself to seal the frame opening 6 and keep the contents from spilling out of bag 3. An adhesive means 5 such as a strip-off adhesive structure is used on the upper surface of frame 2 so that when the frame is folded upon itself the sides can be secured tightly together. While adhesive means are preferred, any suitable closure means may be used. It is important that frame portions 2A and 2B be sealed together with adhesive 5 to prevent odors or contents from escaping from the interior of bag 3. While the adhesive 5 is shown on only one side 2A, it can be used on both sides 2A and 2B if desirable. The frame 2 is slightly larger than the opening 7 in container 8 so that the frame will support and position bag 3 therein. The disposable bag of this invention can be sold or dispensed as a compact, folded, protected unit that can easily be opened and inserted into container 8 without having to pull the bag over the top of the container 8 to secure it. The bag 1 then can be easily removed from container 8 after use and sealed shut merely by folding the frame 2 along fold lines 4 and sticking the sides 2A and 2B together by adhesive 5. In FIG. 2 the bag 1 is shown after use and as it is being folded upon fold lines 4. Adhesive 5 allows sealing means to secure sides 2A and 2B firmly together.

In FIGS. 3 and 4 a disposable bag similar to that of FIGS. 1 and 2 is shown except in FIGS. 3 and 4 it is of a circular configuration. In FIG. 3 frame 9 has fold indentations 10 on the surface around its circumference so that frame sides 11A and 11B can be folded upon themselves. The frame 9 has a diameter slightly larger than that of opening 12 in container 13 so that it will hold the bag and support it in position on top of container 13. By "slightly larger" is meant throughout this disclosure and claims a dimension that just overlaps that of the opening 7 of the container 8 and rests on top of at least one supporting side of container 8. (See FIG. 8.) Bag 14 is suspended downward from frame 9 into container 13. Adhesive 15 is used to secure sides 11A and 11B together after use as shown in FIG. 4.

Figure 8:
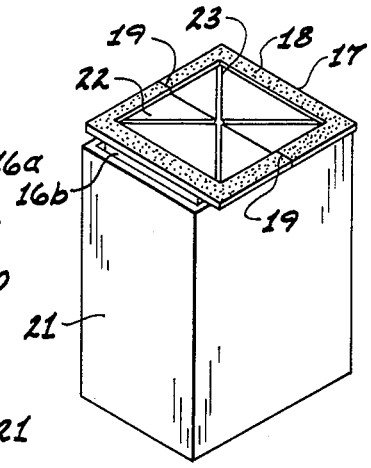
FIG. 8 is a perspective view of the disposable bag of this invention when installed in a container.
Figure 9:
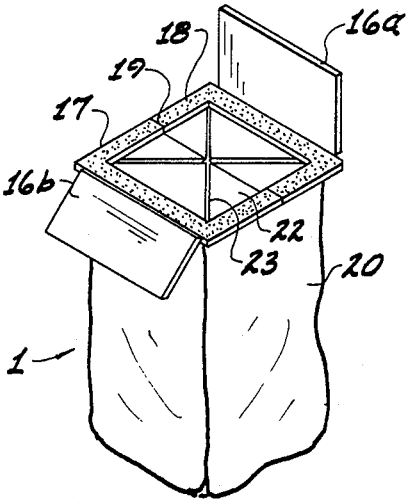
FIG. 9 is a perspective view of the disposable bag of this invention after use and about to be sealed closed.
Figure 9A:
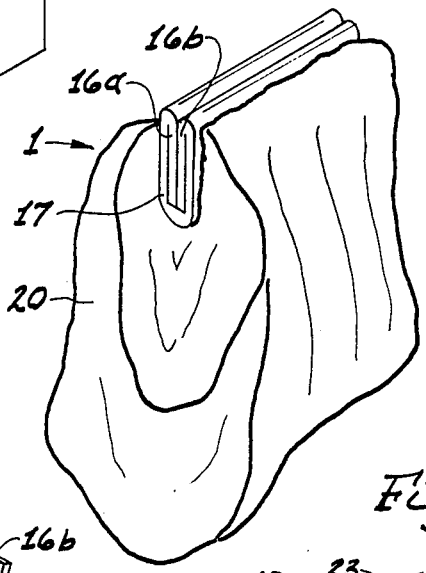
Figure 10:
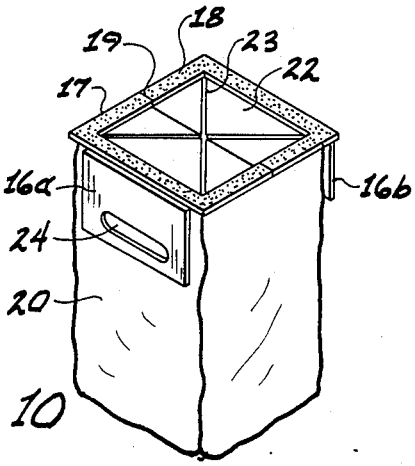
FIG. 10 is a perspective view of the disposable bag of this invention having handle means on its flaps.
Figure 11:
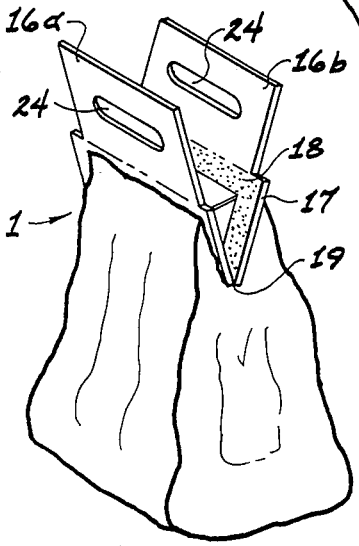
FIG. 11 is a perspective view of the bag of FIG. 10 when used and ready for sealing.

In FIG. 5 a preferred disposable bag 1 is shown having flaps 16A and 16B extending from frame 17 having sides different from sides with fold lines 19. These flaps 16A and 16B are used to firmly secure bag unit 1 in a container (as shown in FIG. 7), each flap having a longitudinal dimension that will closely fit against the interior wall of a container and firmly hold the bag 1 in place. Also, flaps 16A and 16B are used as the outer package for bag structure 1 when it is packed, shipped or stored prior to use as shown in FIG. 6. The adhesive 18 is shown on the upper surface of frame 17 but may also be used on the inside surfaces of flaps 16A and 16B, if desirable. When frame 17 is folded upon fold lines 19, each flap 16A and 16B is about half the size of frame 17 and can be folded over to cover the top opening of frame 17 after bag 20 is filled. Thus, the flaps 16A and 16B are used to package, guide, position, seal and secure the bag unit 1 when in a container. When ready for use bag unit 1 is inserted into a container 21 as shown in FIG. 7 with flaps 16A and 16B pushed in a downward direction so they will abut against an interior wall of container 21 and together with an oversized frame 17 will hold the bag unit 1 firmly in position. A self-closing sheet 22 having slits 23 can be used across the top opening of frame 17. This foil or sheet 22 allows items to be put through the foil or sheet 22 into bag 20. The term "sheet" as used throughout is intended to include foils. The sheet 22 bends to allow items to be passed therethrough then returns to its original closed position due to the rigidity of the sheet portions. While one sheet or foil 22 is preferred, double sheets can be used as disclosed by U.S. Pat. Nos. 3,401,867 or 2,528,332. In FIG. 8 the bag unit 1 is shown completely inserted in container 21. Note that frame 17 extends beyond the walls of container 21 to permit support of bag unit 1 in container 21. FIG. 9 shows bag unit 1 after full and about to be sealed, here a strip-off adhesive means 18 is shown, however, any appropriate closure or adhesive means may be used in any embodiment of this invention. Flaps 16A and 16B can also have an adhesive 18 on their surfaces to permit better sealing after use. After sealing, the structure shown in FIG. 9A is ready for disposal, sealed so contents and odors do not escape from the interior. If desirable, flaps 16A and 16B can have a handle cutout 24 therein for easy carrying of bag unit 1. FIGS. 10 and 11 show the position flaps 16A and 16B during and after use respectively.

Figure 12:
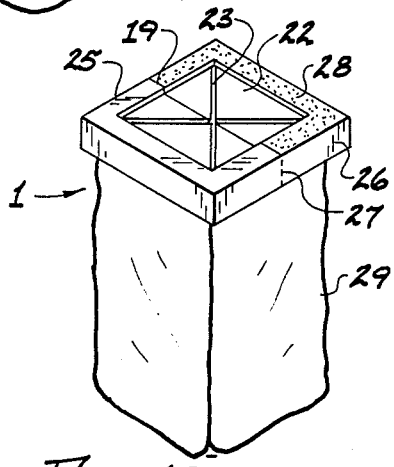
FIG. 12, is a perspective view of the bag of this invention having an upper frame in the form of a box top with downward extending side portions.
Figure 13:
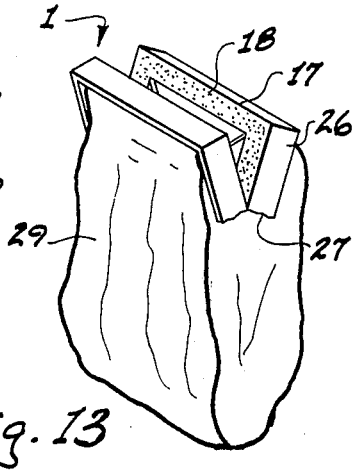
FIG. 13 is the bag of FIG. 12 after use, folded and about to be sealed.

In FIG. 12 the frame 25 of bag unit 1 can have a box-top configuration with downward extending side portions 26. These side portions 26 have perforated tear lines 27 and fold lines 19 to permit the top frame to be folded as in the other figures. The adhesive 28 can be on top of one or both sides as in the other figures so when folded upon tear or fold lines 27 or 19 respectively will seal the bag unit 1 as shown in FIG. 13 after bag 29 is filled.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A disposable waste bag unit comprising in combination an upper frame means, a flexible bag, and adhesive means, said flexible bag attached to a bottom surface of said frame means and suspended therefrom, said bag maintained in a bag open position when said frame is opened providing thereby a top bag opening, said frame having on its frame upper surface an adhesive means for securing said frame in a folded closed position after use, said frame upper surface also containing fold means upon which said frame can be folded upon itself to seal said bag, when in an open position, said frame having outside dimensions slightly larger than an opening of a container in which it is to be used and wherein at least two flaps are located on and extend outwardly from said frame, said flaps flexibly attached to or extensions of said frame at a location at substantially right angles to and different from frame locations containing said fold means on said frame.

2. The disposable waste bag unit of claim 1 wherein at least two flaps are located on and extend outwardly from said frame, said flaps having a length of about half the length or diameter of said frame.

3. The disposable waste bag unit of claim 1 wherein a slitted sheet is positioned and fixed over said top bag opening, said sheet being self-closing and having means whereby it will return to its original position after debris is placed therethrough.

4. The disposable waste bag unit of claim 1 wherein said frame and said attached bag have a rectangular configuration.

5. The disposable waste bag unit of claim 1 wherein said frame and said attached bag have a circular configuration.

6. The disposable waste bag unit of claim 1 wherein said frame is a box-type frame having downwardly extending sides, said frame having outer dimensions slightly larger than that of an opening of a container in which it will be used.

7. A disposable waste bag unit comprising in combination an upper frame means, a flexible bag, adhesive means, and frame flaps, said flexible bag attached to a bottom surface of said frame means and suspended therefrom, said bag maintained in a bag open position when said frame is opened providing thereby a bag opening, said frame having an adhesive means for securing said frame in a folded closed position after use, said frame upper surface also containing fold means upon which said frame can be folded upon itself to seal said bag opening, said frame having outside dimensions slightly larger than an opening of a container in which it is to be used, said frame flaps flexibly extending outwardly from said frame and enclosing said bag unit when in a folded position, said flaps capable of covering substantially the entire bag opening when in a folded position.

8. The disposable waste bag unit of claim 7 wherein at least two flaps are located on and extend outwardly from said frame, said flaps flexibly attached to said frame on both sides at right angles to and different from said sides containing said fold means.

9. The disposable waste bag unit of claim 7 wherein at least two flaps are located on and extend outwardly from said frame, said flaps having a length of about half a length of said frame.

10. The disposable waste bag unit of claim 7 wherein a slitted sheet is positioned and fixed over said top bag opening, said sheet being self-closing and having means whereby it will return to its original position after debris is placed therethrough.

11. The disposable waste bag unit of claim 7 wherein said frame and said attached bag have a rectangular configuration.

12. The disposable waste bag unit of claim 7 wherein said frame and said attached bag have a circular configuration.

13. The disposable waste bag unit of claim 7 wherein said frame is a box-type frame having downwardly extending sides, said frame having outer dimensions slightly larger than that of an opening of a container in which it will be used.

14. The disposable waste bag unit of claim 7 wherein said flaps have handle cutout means positioned therein.

* * * * *